United States Patent [19]

Lewis et al.

[11] 4,070,577

[45] Jan. 24, 1978

[54] IMAGING SYSTEMS WITH FLUORESCENT AND PHOSPHORESCENT TONER

[75] Inventors: John H. Lewis, Los Angeles; Robert A. Young, Chatsworth, both of Calif.

[73] Assignee: Xonics, Inc., Van Nuys, Calif.

[21] Appl. No.: 722,277

[22] Filed: Sept. 10, 1976

[51] Int. Cl.[2] ..... G03G 13/00

[52] U.S. Cl. ..... 250/315 A; 250/461 R

[58] Field of Search ..... 250/315 A, 461

[56] References Cited

U.S. PATENT DOCUMENTS

| | | | |
|---|---|---|---|
| 2,940,848 | 6/1960 | Kostelec et al. | 250/315 A X |
| 3,854,043 | 12/1974 | Hukase et al. | 250/315 A |
| 3,940,620 | 2/1976 | Houston et al. | 250/315 A |
| 3,965,352 | 6/1976 | Allan et al. | 250/315 A |

*Primary Examiner*—Archie R. Borchelt

*Attorney, Agent, or Firm*—Harris, Kern, Wallen & Tinsley

[57] ABSTRACT

Apparatus and method for improving contrast in the visual image formed by toner deposited on an electrostatic image such as is formed in xerography and ionography. Hard copy and real time electrostatic imaging systems utilizing a fluorescent toner in the form of particles having a fluorescent core and an electrophoretic coating. A viewing system with a radiation source of a wavelength for exciting the fluorescent toner particles and preferably a filter for suppressing the excitation radiation in the fluorescent image.

6 Claims, 4 Drawing Figures

IMAGING SYSTEMS WITH FLUORESCENT AND PHOSPHORESCENT TONER

BACKGROUND OF THE INVENTION

This invention relates to electrostatic imaging and in particular, to a new and improved process and apparatus for improving the contrast in visual images produced by depositing toner onto an electrostatic image.

Various types of electrostatic imaging systems are known today. One type is the xerographic copying machine where an electrostatic charge image is produced on a dielectric such as a sheet of paper, after which the dielectric is exposed to a cloud of toner particles with particles being selectively attracted as a function of the charge density to produce a visual image.

The X-ray imaging system sometimes referred to as ionography or electronradiography produces an electrostatic charge image on a dielectric such as a plastic sheet, with the receptor then being exposed to a cloud of toner particles or to a liquid with toner particles suspended therein, to produce the visual image. One such electronradiography system is shown in U.S. Pat. No. 3,774,029.

The systems discussed above provide hard copies or permanent copies with the visual image bonded to the receptor. Another type of imaging system which produces visual images in real time is shown in U.S. Pat. No. 3,965,352. In this type of system, the electrostatic charge image is formed on a surface exposed to a dielectric liquid with the toner particles suspended therein. When an appropriate electric field is produced in the system, toner particles are selectively attracted to the electrostatic charge image producing a toner particle image which can be viewed by reflected light or scattered light. The process of forming the visual image is reversible by reversing the electric field, leaving the systen ready for forming another electrostatic image and subsequent visual image.

All of these imaging systems utilize electrophoretic particles which have a core and a cover or coating. The core normally is a pigment which provides color, typically black for the office copier and white for the real time imaging system. The coating provides the desired electrophoretic characteristics.

The contrast in a visual image depends to a considerable degree on the number of toner particles which form the image. Hence an electrostatic image with a high charge density will produce a higher contrast visual image, i.e., will provide an imaging system with higher gain. Some of the electrostatic imaging systems produce relatively low charge density and considerable work has been performed in developing electrophoretic particles which will be attracted to low charge density areas to provide high particle density and therefore high contrast visual images.

It is an object of the present invention to provide a new and improved process and apparatus for increasing the contrast in the resultant visual image of an electrostatic imaging system.

SUMMARY OF THE INVENTION

The present invention provides a new and improved toner for use in making visual images from electrostatic charge images, which toner comprises electrophoretic fluorescent particles, such as particles having a core of fluorescent material and a coating of conventional electrophoretic charge determining or charge controlling material. The invention is suitable for use with both hard copy systems and real time imaging systems, with the new toner particles being directly substituted for the conventional toner particles. The substrate with the toner particles deposited thereon is exposed to illumination of a wavelength which excites emission from the particles. The visual image produced by the fluorescing toner particles may be enhanced by viewing through a filter which suppresses the exciting radiation while passing the particle radiation. The resultant visual image may be viewed or photographed or otherwise recorded as desired.

DESCRIPTION OF THE PREFERRED EMBODIMENTS

Figure 3:
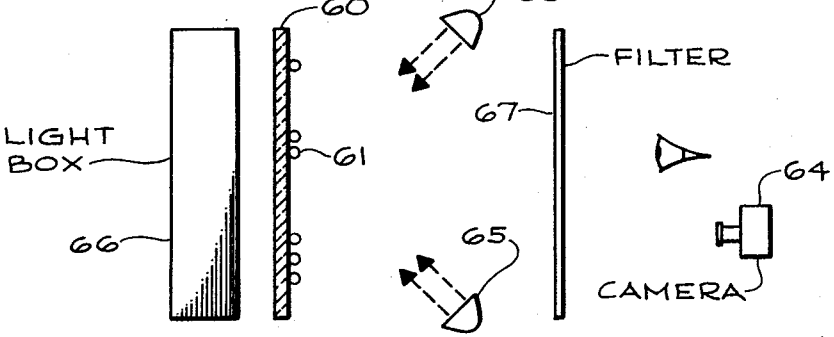
FIG. 3 illustrates a viewing system for the substrate of FIG. 2.
Figure 1:
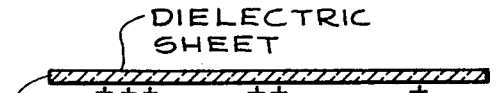
FIG. 1 is a sectional view through a substrate such as a dielectric sheet, with an electrostatic charge image thereon.
Figure 2:
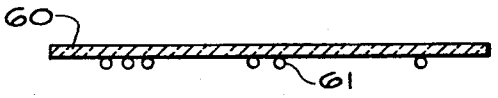
FIG. 2 is a view of the substrate of FIG. 1 with toner particles attracted by the electrostatic charges forming a visual image.

In the embodiment illustrated in FIGS. 1–3, an electrostatic charge image is formed on a substrate 60 by any of the imaging processes. The substrate typically is a sheet of paper or a sheet of plastic. The electrostatic charges are indicated by the plus signs along the lower surface of the substrate. The electrostatic charge image is developed into a visual image by exposing the charged substrate to a toner, attracting toner particles 61. Any of the conventional developing equipment and processes may be utilized, with the toner in a dry powder cloud or suspended in a liquid.

The substrate 60 with the toner particles 61 is ready for viewing. However when making hard copies, it is preferred to bond or fuse the toner particles in place by heating, and to cover the surface of the substrate carrying the toner particles with a protective coating.

The toner comprises electrophoretic fluorescent particles, with the particles preferably having a core of a fluorescent material and a coating of an electrophoretic charge controlling material. Conventional phosphors may be used as the fluorescent material, such as zinc sulfide, calcium sulfide and strontium sulfide. A fluorescent material when excited with radiation of one wavelength, emits radiation of another wavelength. Some specific phosphors are set out in Table 1 which also gives the peak wavelength for excitation of the phosphor and the peak wavelength of the emission of the phosphor.

Table 1

| Phosphor | Excitation (A) | Emission (A) |
|---|---|---|
| 1. Sr(S:Se):Sm:Eu | 4600 | 5700 |
| 2. SrS:Sm:Eu | 4800 | 6300 |
| 3. Ca(S:Se):Sm:Eu | >4800 | 6300 |
| 4. CaS:Sm:Eu | >4800 | 6600 |
| 5. SrS:Sm:Ce | 2900 | 4800 |
| | 3500 | 5400 |
| 6. ZnS:Cu:Pb[$SO_4$]:[NaCl] | 3700 | 4880 |

The electrophoretic charge controlling agent on the core of the fluorescent particle may be conventional, with the choice of the coating material and the mode of formation of the particle being optional, depending on the specific electrostatic imaging system utilized.

In FIG. 3, the substrate 60 with the visual image formed of toner particles 61 is positioned for viewing and/or recording, as by photographing with a camera 64. Radiation may be directed onto the substrate from lamps 65. Alternatively, the radiation may be provided from the opposite surface of the substrate as by utilizing a light box 66. A filter 67 may be positioned between the substrate and the viewing position, if desired. The radiation source, such as the lamp 65 or the light box 66, is selected to provide radiation of a wavelength which will excite emission from the fluorescent particles. When exposed to this excitation radiation, the particles fluoresce producing a visual image with increased contrast. A dark field viewing is preferred, and the filter may be used to have low transmission at the wavelength of the excitation radiation and high transmission at the wavelength of the fluorescent emission.

Figure 4:
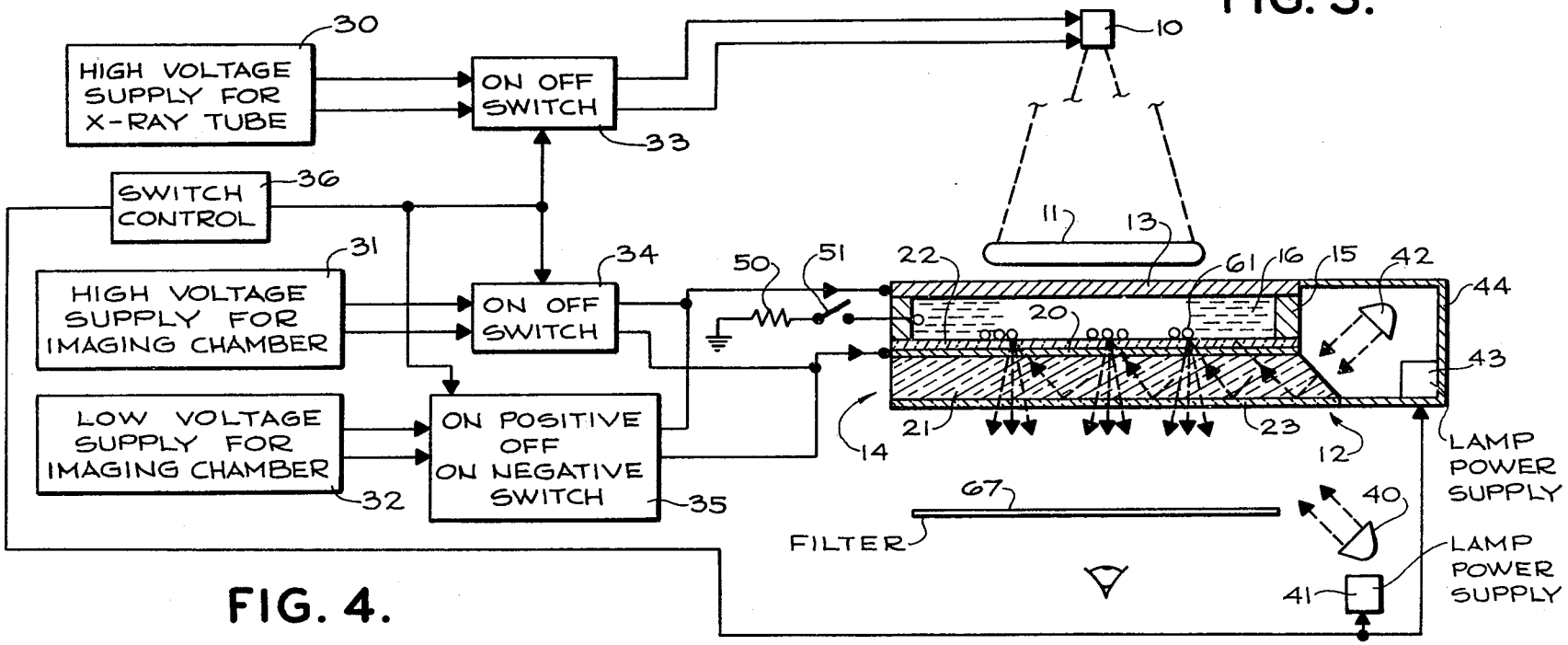
FIG. 4 is a diagrammatic illustration of an electronradiography system with a real time imaging chamber and incorporating the presently preferred embodiment of the invention.

The use of the invention in a specific real time imaging system of the type shown in U.S. Pat. No. 3,965,352, is shown in FIG. 4. In this system, an X-ray source 10 directs radiation through a body 11 to an imaging chamber 12. The imaging chamber includes an upper electrode 13 and a lower electrode 14 separated by spacers 15 defining a gap 16 between the electrodes.

The upper electrode 13 should be of a material which is relatively transparent to X-ray radiation and beryllium is a preferred metal. The lower electrode 14 should be relatively transparent optically and typically may comprise a thin transparent film 20 of an electrical conducting material such as a metal oxide on a glass or plastic support plate 21. A dielectric film 22 is applied on the gap surface of the electrode film 20, and typically may be a thin plastic sheet. The electrical resistance of the dielectric film may be chosen to obtain optimum imaging formation and erasure, or may be a transparent photoconductor which changes resistivity synchronously with the image formation and erasure process. If desired, a conventional non-reflecting film 23 may be applied on the outer surface of the support plate 21.

Electrical power supplies are provided for the X-ray source and the imaging chamber and typically may inclue a high voltage supply 30 for the X-ray tube, a high voltage supply 31 for the imaging chamber, and a low voltage supply 32 for the imaging chamber. The voltage supply to the X-ray source 10 is controlled by an on-off switch 33. The voltage supply to the imaging chamber 12 is controlled by an on-off switch 34 and another switch 35 which can provide a positive supply, a negative supply and an off condition. The sequence of operation of the switches 33, 34, 35 is controlled by a switch control unit 36.

The image formed in the chamber 12 may be viewed by transmitted light if both electrodes are optically transparent, by reflected light or by scattered light. FIG. 4 illustrates a lamp 40 energized from a power supply 41 directing light onto the electrode 14 for reflection illumination. Another lamp 42 energized from a power supply 43 is mounted in a closed housing 44 at one edge of the imaging chamber for directing light into the plate 21 to provide dark field illumination and scattered light viewing.

In the embodiment illustrated, the gap 16 between the electrodes is filled with a liquid X-ray absorber and electron and positive ion emitter. Reference may be had to U.S. Pat. No. 3,873,833 for additional information on the liquid absorber and emitter. Electrophoretic fluorescent particles 61 are suspended in the liquid in the gap.

A typical operating cycle may be divided into time segments A, B, C and D. At the end of the time segment A, there is no voltage across the electrodes and the electrophoretic particles 61 are dispersed throughout the liquid absorber in the gap 16. In time segment B, the X-ray source is energized and a high voltage is connected across the electrodes with the electrode 14 negative. Incoming X-rays are absorbed in the gap and electrons (or negative ions) and positive ions are generated in the gap. The electrons are rapidly moved to the electrode 13 and the positive ions are rapidly moved to the electrode 14 under the influence of the field through the gap, providing the electrostatic charge image. The electrostatic charge image remains after the X-ray source is turned off in time segment C. The electrophoretic particles 61 are relatively bulky compared to the electrons and positive ions and therefore do not travel nearly as fast as the electrons and positive ions, that is, there is a substantial differential in the mobility of the particles and the electrons and ions in the liquid absorber. Hence, the particles remain in the liquid during the relatively short time of segment C while the high voltage is connected across the electrodes. The voltage across the electrodes is reduced in time segment D and electrophoretic particles are attracted to the electrode 14 at those portions which do not have positive ions thereon. The positively charged electrophoretic particles are repelled by the positive ions on the electrode 14. This selective depositing of the particles provides the desired image which can be viewed during the time segment D.

At the end of the viewing time, the potential across the electrodes may be reversed for a short time during time segment A to move the particles from the electrode back into the dispersion. A typical exposure and viewing cycle may occur in one-tenth of a second, providing ten viewing frames per second. It is desirable to discharge any remaining charge in the liquid before the next X-ray exposure in segment B and this may be accomplished by providing an electrical connection from the liquid to ground through a resistor 50 and a switch 51. The switch 51 may be closed during time segment A to accomplish the discharge. Alternatively, the switch 51 may be omitted with a direct connection through the resistor to circuit ground, with the parameters chosen so that the ground connection does not adversely affect the operation during X-ray exposure but does accomplish the desired discharge function.

The various modes of viewing may be utilized. In the transillumination mode, light enters the gap 16 through the electrode 13, with light being blocked by the deposited particles and passing through the electrode 14 in areas not blocked by deposited particles. For this mode, the electrode 13 needs to be relatively transparent and typically may comprise a glass plate with a thin electrical conducting film on the inner surface. In a reflection illumination mode using lamp 40, light is directed onto the electrode 14 and is reflected by deposited particles.

A dark field illumination mode is available using a light wave of substantially total internal reflection produced in the plate 21. This may be achieved by introducing light from the lamp 42 into the edge of the plate 21 at the appropriate angle for achieving internal reflection at the interfaces. When a small particle rests on the external surface at the reflection interface, it will disrupt the incident internal wave and scatter the radiation, thus becoming a point source of light when viewed from the exterior of the imaging chamber. Other locations on the inner surface of the electrode 14 which do not have a particle to serve as a scattering center will appear perfectly black if the electrode 13 is opaque.

The light sources in the system of FIG. 4 are selected to provide radiation of a wavelength suitable for exciting the particular phosphor or phosphors used in the electrophoretic fluorescent particles 61 so that the particles will emit radiation at their characteristic emission wavelength. If desired, a filter 67 may be positioned between the visual image and the viewing position, with the filter having high transmission for the phosphor emission wavelength and low transmission for the excitation lamp wavelength. If desired, the excitation lamp or lamps can be of the flash type producing a pulse of radiation of relatively high intensity and short duration, with the lamp pulsing synchronized with the operation of the imaging chamber.

Phosphors fluoresce when excited and the term "fluorescent" is used herein to identify such materials. "Phosphorescent" and "fluorescent" are sometimes used referring to phosphors, and "fluorescent" as used herein is intended to include both terms.

We claim:

1. In an electronradiography imaging chamber for providing a visual image, the combination of:

first and second electrodes;

means for supporting said electrodes in spaced relation with a gap therebetween;

an X-ray absorber and electron and positive ion emitter in said gap, with X-ray radiation from a first source entering said gap being absorbed and providing electrons and positive ions in said gap;

a plurality of movable electrophoretic fluorescent particles in said gap;

means for connecting an electric power source across said electrodes for attracting electrons toward one electrode and positive ions toward the other depending upon the polarity of the power source and forming an electrostatic charge image, with said particles being selectively deposited as a function of said electrostatic charge image forming a particle image; and means for directing radiation from a second source onto deposited particles, with said radiation of a wavelength to excite emission from said particles and provide a visual image viewable through one of said electrodes.

2. Apparatus as defined in claim 1 including a filter disposed between said particle image and a viewing position, with said filter having a relatively high transmission at the emission wavelength of said particles and a relatively low transmission at the wavelength of said excitation radiation.

3. Apparatus for improving contrast of an electrophoretic particle image, comprising in combination:

a sheet having a plurality of movable electrophoretic flourescent particles deposited thereon forming a particle image;

a source of radiation of a wavelength to excite emission from said particles; and means for directing radiation from said source onto said particle image producing a visual image.

4. Apparatus as defined in claim 3 including a filter disposed between said particle image and a viewing position, with said filter having a relatively high transmission at the emission wavelength of said particles and a relatively low transmission at the wavelength of said excitation radiation.

5. Apparatus as defined in claim 3 wherein said radiation directing means directs radiation through said sheet toward a viewing position.

6. Apparatus as defined in claim 3 wherein said radiation directing means directs radiation onto said particle image from the viewing position side.

* * * * *